US007241135B2

(12) United States Patent
Munsterhuis et al.

(10) Patent No.: US 7,241,135 B2
(45) Date of Patent: Jul. 10, 2007

(54) FEEDBACK CONTROL FOR MODULATING GAS BURNER

(75) Inventors: Sybrandus Munsterhuis, Orono, MN (US); Rolf L. Strand, Crystal, MN (US)

(73) Assignee: Honeywell International Inc., Morristown, NJ (US)

( * ) Notice: Subject to any disclaimer, the term of this patent is extended or adjusted under 35 U.S.C. 154(b) by 90 days.

(21) Appl. No.: 10/991,907

(22) Filed: Nov. 18, 2004

(65) Prior Publication Data

US 2006/0105279 A1 May 18, 2006

(51) Int. Cl.
*F21N 5/20* (2006.01)
*F23N 5/00* (2006.01)

(52) U.S. Cl. ..... 431/12; 431/89; 431/24; 431/78

(58) Field of Classification Search ..... 431/18, 431/19, 38, 78, 89, 12, 24, 75
See application file for complete search history.

(56) References Cited

U.S. PATENT DOCUMENTS 3,741,166 A 6/1973 Bailey
4,118,172 A 10/1978 Noir et al.
4,296,727 A 10/1981 Bryan
4,298,335 A 11/1981 Riordan et al.
4,348,169 A 9/1982 Swithenbank et al.
4,405,299 A 9/1983 Serber
4,444,551 A 4/1984 Mueller et al.
4,461,615 A 7/1984 Inoue
4,474,548 A 10/1984 Miyanaka et al.
4,501,127 A 2/1985 Sommers et al.
4,507,702 A 3/1985 Grewe
4,508,501 A 4/1985 Kuhn
4,516,930 A 5/1985 Dietz
4,533,315 A 8/1985 Nelson
4,541,407 A 9/1985 Sommers et al.
4,545,208 A 10/1985 Kuhn
4,568,266 A 2/1986 Bonne
4,585,631 A 4/1986 Pfeiffer
4,588,372 A 5/1986 Torborg
4,591,337 A 5/1986 Gillhaus
4,645,450 A 2/1987 West
4,659,306 A 4/1987 Altemark et al.
4,662,838 A 5/1987 Riordan
4,688,547 A 8/1987 Ballard et al.
4,695,246 A 9/1987 Beilfuss et al.
4,729,207 A 3/1988 Dempsey et al.
4,738,577 A 4/1988 Schalberger
4,802,142 A 1/1989 Korsmeier et al.
4,825,198 A 4/1989 Rolker et al.
4,836,770 A 6/1989 Geary
4,856,331 A 8/1989 Roese et al.
4,859,171 A 8/1989 Altemark et al.

(Continued)

FOREIGN PATENT DOCUMENTS

DE 36 30 177 3/1988

(Continued)

*Primary Examiner*—Josiah Cocks
*Assistant Examiner*—Sarah E. Suereth

(57) ABSTRACT

A modulating gas burner control system using closed loop feedback from a flame rod which provides a signal that varies with gas pressure and which provides combustion air fan control to accurately control the heat from the system without use of expensive control valves.

27 Claims, 1 Drawing Sheet

U.S. PATENT DOCUMENTS

| | | | | |
|---|---|---|---|---|
| 4,886,450 | A | 12/1989 | Heuss | |
| 4,901,567 | A | 2/1990 | Bertke et al. | |
| 4,927,350 | A | 5/1990 | Zabielski | |
| 4,934,926 | A | 6/1990 | Yamazaki et al. | |
| 4,941,345 | A | 7/1990 | Altemark et al. | |
| 4,955,806 | A | 9/1990 | Grunden et al. | |
| 4,960,378 | A | 10/1990 | Jannemann et al. | |
| 4,975,043 | A | 12/1990 | Katchka et al. | |
| 4,982,721 | A | 1/1991 | Lynch | |
| 5,027,789 | A | 7/1991 | Lynch | |
| 5,037,291 | A | 8/1991 | Clark | |
| 5,049,063 | A | 9/1991 | Kishida et al. | |
| 5,055,032 | A | 10/1991 | Altemark et al. | |
| 5,073,104 | A | 12/1991 | Kemlo | |
| 5,112,217 | A | 5/1992 | Ripka et al. | |
| 5,158,447 | A | 10/1992 | Geary | |
| 5,158,448 | A | 10/1992 | Kawasaki et al. | |
| 5,169,301 | A | 12/1992 | Donnelly et al. | |
| 5,195,885 | A | 3/1993 | Medina | |
| 5,333,591 | A | 8/1994 | Korsmeier et al. | |
| 5,432,095 | A | 7/1995 | Forsberg | |
| 5,439,374 | A | 8/1995 | Jamieson | |
| 5,472,336 | A | 12/1995 | Adams et al. | |
| 5,472,337 | A | 12/1995 | Guerra | |
| 5,506,569 | A | 4/1996 | Rowlette | |
| 5,534,781 | A | 7/1996 | Lee et al. | |
| 5,548,277 | A | 8/1996 | Wild | |
| 5,549,469 | A | 8/1996 | Wild et al. | |
| 5,556,272 | A | 9/1996 | Blasko et al. | |
| 5,576,626 | A | 11/1996 | Lo | |
| 5,577,905 | A | 11/1996 | Momber et al. | |
| 5,599,180 | A | 2/1997 | Peters et al. | |
| 5,902,098 | A * | 5/1999 | Park | 431/6 |
| 5,971,745 | A | 10/1999 | Bassett | |
| 6,113,384 | A * | 9/2000 | Sebastiani | 431/12 |
| 6,299,433 | B1 | 10/2001 | Gauba et al. | |
| 6,332,408 | B2 | 12/2001 | Howlett et al. | |
| 6,414,494 | B1 | 7/2002 | Schmidt et al. | |
| 6,509,838 | B1 | 1/2003 | Payne et al. | |
| 6,527,541 | B2 | 3/2003 | Lochschmied | |
| 6,866,202 | B2 | 3/2005 | Sigafus et al. | |
| 7,048,536 | B2 * | 5/2006 | Sullivan et al. | 431/12 |
| 2003/0059730 | A1 | 3/2003 | Sigafus | |

FOREIGN PATENT DOCUMENTS

| | | |
|---|---|---|
| DE | 44 33 425 | 3/1996 |
| DE | 195 02 901 | 3/1996 |
| DE | 195 02 900 | 8/1996 |
| DE | 195 02 905 | 8/1996 |
| DE | 195 24 081 | 1/1999 |
| DE | 198 57 238 | 11/2000 |
| EP | 0 021 035 | 8/1983 |
| EP | 0104586 | 4/1984 |
| EP | 0 352 433 | 1/1990 |
| EP | 0 697 637 | 2/1996 |
| EP | 1011037 | 6/2000 |
| FR | 2 666 401 | 3/1992 |
| GB | 710805 | 6/1954 |
| GB | 1193976 | 6/1970 |
| JP | 52-13139 | 2/1977 |
| JP | 56-157725 | 12/1981 |
| JP | 59-189215 | 10/1984 |
| JP | 59-221519 | 12/1984 |
| JP | 62-258928 | 11/1987 |
| JP | 2-302520 | 12/1990 |
| JP | 3-156209 | 7/1991 |
| JP | 6-42741 | 2/1994 |
| JP | 60-93231 | 5/1998 |
| WO | 81/01605 | 6/1981 |

* cited by examiner

FEEDBACK CONTROL FOR MODULATING GAS BURNER

BACKGROUND OF THE INVENTION

1. Field of the Invention

The present invention relates to gas burner control and more particularly to feedback control for modulating gas burners.

2. Description of the Prior Art

Gas burners employ a source of gas which passes through a regulator to control the flow emitted through an orifice. A source of air is mixed with the gas and the gas/air mixture is transmitted to a burner where an igniter causes combustion. The resulting flames are thrown past a flame sensor into a heat exchanger that transfers heat to a supply of air directed to the space to be heated. The flow of burning gas/air mixture in the heat exchanger is controlled by a combustion fan at one end. The gas/air flow is proportional to the RPM of the fan which is typically supervised by an air pressure switch. Changes in fan speed cause changes in the amount of heat exchanged and the heat that is directed to the space to be heated may be controlled. However, as the speed of the fan is changed, the ratio of gas to air in the gas/air mixture must also be changed to maintain good combustion and keep efficiency within an acceptable range It is known that the ratio of gas to air in the gas/air mixture needs to be within certain limits in order to provide good combustion and efficiency. The gas flow may be controlled by an electric modulating gas valve with a gas pressure regulator. Modulating gas burners have been constructed to attempt to obtain the desired gas/air mixture under various conditions but existing modulating gas burners normally rely on open loop control of the gas and air relationship. This leads to two problems: the first is the production tolerance of the modulating gas valve and the second is the tolerance of the combustion air control system.

In FIG. 1, the modulating signal to two hypothetical production valves is shown plotted against the percent of maximum output pressure. The variation of a high limit valve in a typical production batch may be shown by line 2 and the variation of a low limit valve from the batch may be shown by line 4. The values for the modulating signals are arbitrary values representing desired output pressures. For example, if an output is desired to be 40% of the maximum, the modulating signal request may be set at 40. However, because of the variations in the valves of a batch, it is seen that the valves representing the high and low members of the batch may produce outputs between about 30% and about 43% of the maximum when the modulating signal is set at an output request of level 40. For optimal efficiency, this range should be lower and while the range can be lowered by achieving tighter tolerances for the modulating valves in a batch, this is quite impractical for a low cost gas valve.

SUMMARY OF THE INVENTION

The present invention solves these problems by providing a feedback signal to give an indication of the output level so that the input signal can be adjusted via a closed loop control to achieve the desired output level. In order to detect the output gas flow, we have discovered that the flame ionization signal from a flame sensor, such as mentioned in German Patent P19857238.7 granted Apr. 7, 2000 and that has been used to detect the presence of flame and to provide a shut down of the gas valve if the flame should fail to light or is extinguished after lighting, is also a signal which varies in a predictable fashion with gas flow. By using a predetermined relationship, a controller can monitor the flame ionization level and use it as a feed back signal to adjust the modulation input signal and thus obtain the desired output pressure. However, the flame ionization signal may change with contamination of the flame rod over a period of time so an automatic field calibration should be performed to maintain accuracy.

Accordingly, the present invention also provides calibration by driving the gas valve with a maximum modulation signal which is guaranteed to open the gas valve to a calibrated high pressure setting. The tolerance of the high pressure setting is easily controlled to a tight range of values. The flame is ignited at the high level and the flame ionization signal is recorded. From this high fire flame ionization level, the system determines the flame ionization levels for other output flows. Thus the appliance can be controlled in a narrower pressure tolerance band than could be obtained without this type of feedback control.

Like the gas pressure calibration, the airflow also needs to be automatically calibrated. This is required for the proper accuracy of the gas/air mixture at any point in the modulating range. In the present invention, the airflow is modulated by modulating the fan speed of the combustion air blower to be described. The RPM of the fan is supervised through an RPM sensor. The maximum setting airflow is calibrated by increasing the airflow (by increasing the RPM) until the set point of the pressure switch is reached. This point corresponds to the maximum load or 100% airflow. Now the airflow is calibrated. The airflow from this maximum point is proportional to the RPM of the fan at a certain temperature.

DETAILED DESCRIPTION OF THE PREFERRED EMBODIMENTS

Figure 1:
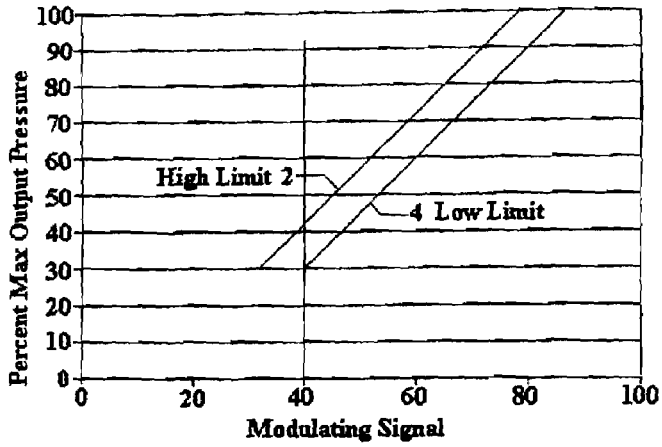
FIG. 1 shows a graph of modulating signals vs. percent of maximum output pressure in a modulating valve.
Figure 2:
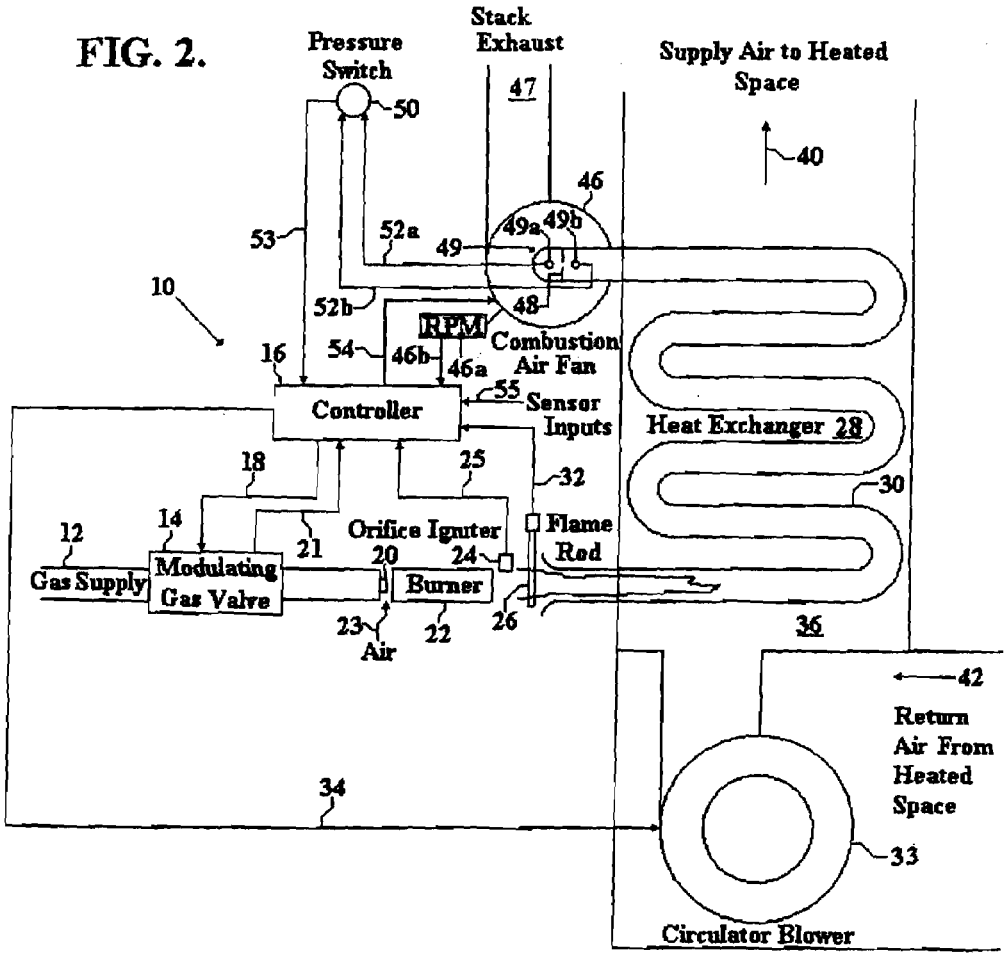
FIG. 2 shows a gas furnace heating system utilizing the present invention.

In FIG. 2, a gas burner control system 10 is shown connected to a gas supply 12 to provide a source of gas to a modulating gas valve 14. A controller 16 is shown providing a modulation signal to gas valve 14 over a connection 18 to control the opening of gas valve 14 and thus control the gas flow through an orifice 20. Gas valve 14 also receives on and off signals from the controller 16 over a connection 21. A burner 22 receives the gas flow from orifice 20 and also receives air from a source shown by arrow 23 and the gas and air become mixed. An igniter 24 that is activated from the controller 16 over a line 25 ignites the gas/air mixture and produces a flame which leaves the burner 22 and is thrown past a flame rod 26 into a heat exchanger 28 shown as a snake-like tube 30. As mentioned, flame rod 26 senses the presence of flame and provides a signal over a line 32 to the controller 16 to shut down the gas valve if the flame should fail to light or is extinguished after lighting. As will be explained, this signal also varies in a predictable fashion with gas output pressure from gas valve 14 and, in our invention, is used to modulate the control of the gas pressure.

Controller 16 also controls the speed of a circulator blower 33 by way of a line 34 and the circulator blower 33 pushes air into a chamber 36 where the heat exchanger 28 is located. Heat is transferred from the heat exchanger 28 to the passing air in chamber 36 to supply heated air, as shown by arrow 40, to a desired heated space. Air from the heated space is also returned to the circulator blower 33 as shown by arrow 42.

The amount of heat transferred to the air 40 is a function of the burning gas/air flow through the snake like tube 30 which, as mentioned, is controlled by the speed of a combustion air fan 46 that receives the gas/air combustion flow from tube 30 and throws the exhaust out of a stack 47. Combustion air fan 46 includes an RPM sensor 46*a* associated therewith to produce a signal indicative of fan speed on a line 46*b* to the controller 16.

Also, as mentioned, the gas/air flow is a function of the pressure of the gas/air mixture generated by the combustion air fan 46. A flange, 48 is located at the end of tube 30 and, the pressure difference over flange 48, which could also be a venturi, is sensed using pressure pick up points 49*a* and 49*b* on either side thereof. The actual pressures are led to a pressure switch 50 over lines 52*a* and 52*b* respectively. Pressure switch 50 is a diaphragm type that, based on the pressure differential on the diaphragm and setting, acts on an electric switch to produce a signal. The signal from pressure switch 50 indicative of switch action is presented to controller 16 over a line 53. The switch action enables the controller to determine the status of the pressure switch 50 and can be a high or low pressure indication due to switch contact being made or not. At each start-up, the airflow must be proven and the RPM of the combustion fan 46 is ramped up until the pressure switch set point is achieved and switch 50 switches. The RPM at this point represents 100% airflow (within the tolerances of the pressure switch 50 set point). From this 100% point, the actual RPM needed can be calculated by:

$$RPM_{Required}=Q_{/Required}/Q_{Max}*RPM_{100\%}$$

Where Q represents airflow volume.

Controller 16 produces a speed control signal to combustion air fan 46 by a line 54 to cause the desired airflow to be maintained and sets and controls the required RPM for the required load. The load requirement at any point depends on the deviation of the sensor inputs to the controller 16, its set point and the control algorithm. The sensor inputs are shown in FIG. 2 on an input 55 which may be connected to multiple temperature sensors and limit sensors typically located at the input or output of the heat exchanger. They may also be connected to room thermostats or outdoor temperature sensors all of which are not shown in FIG. 2 but which are all well known in the art. The control algorithm programmed in the controller 16, processes these sensor inputs to determine the heat demand and the heating rate (30% to 100%).

The airflow must match the gas flow at any point in the control range. That is, the predetermined gas/air ratio at a certain firing rate (between low rate and 100% rate) is equal to the actual rate within the tolerance range. Full capacity represents 100% airflow and 100% gas flow. It is clear that in this linear one-to-one gas/air relation, 40% airflow matches with 40% gas flow for a good combustion at low rate. (40% of full rate is considered to be a "low rate".) The controller 16 can also work with a predetermined offset (in air or gas). Any predetermined offset will depend on the specific application for which the invention is used and controller 16 will have an appropriate mathematical function, the transfer function, stored therein so as to produce the offset. For example, to prevent condensation in the heat exchanger 28, it may be desirable to run the combustion in burner 22 at a higher excess air flow rate for low fire conditions than at high fire conditions. The desired offsets can be easily included in the controller 16. As mentioned above, we have found that the output of flame rod 26, when properly installed in the flame, is a predetermined function of the gas pressure and may thus be used to control the operation of modulating valve 14. The predetermined function can be as simple as a linear function where Desired Flame Current=K×(Firing Rate+Offset). Controller 16 uses the Desired Flame Current as a set point for a feedback control loop, using Measured flame Current as its input, that controls the valve setting to maintain the Desired Flame Current.

As also mentioned, the output of the flame rod 26 can change with time and thus, the output should be periodically calibrated to assure accuracy is maintained. This calibration is performed by driving the modulating valve to the maximum open condition and measuring the signal from the flame rod. Then, the pressures at various smaller openings can be accurately predicted from the maximum flow signal because the calibration will modify the "K" and the "Offset" in the above equation.

One method by which the flame current can be calibrated is to read the actual flame current while the valve is fully open. At this point the outlet pressure of the gas valve is controlled via the internal regulator having a fixed set-point, therefore, the firing rate is well known. The flame current value is read as Current Full Fire by the controller.

Current Full Fire is then used to calculate K Calibrated:

$$K\ \text{Calibrated}=(\text{Current Full Fire}-\text{Offset})/\text{Full Firing Rate}$$

This K Calibrated and/or the Current Full Fire are saved in memory for future use by the controller.

The current at other firing rates is now calculated by:

$$\text{Desired Flame Current}=K\ \text{Calibrated}*\text{Firing Rate}+\text{Offset}$$

A second method can calibrate the Offset value and the K value if the valve has two regulated pressure settings. The full fire current is measured as above. The valve is then activated at a regulated low fire point where the pressure is again controlled to a known pressure. An additional current is measured at the low fire rate as Current Low Fire. The calibrated K term is calculated as:

$$K\ \text{Calibrated}=(\text{Current Full Fire}-\text{Current Low Fire})/(\text{Full Fire Rate}-\text{Low Fire Rate})$$

$$\text{Offset Calibrated}=\text{Current Full Fire}-K\ \text{Calibrated}*\text{Full Fire Rate}$$

The current at other firing rates is now calculated by:

$$\text{Desired Flame Current}-K\ \text{Calibrated}*\text{Firing Rate}+\text{Offset Calibrated.}$$

Should the Offset need to be calibrated on a valve with only one regulator setting, it may be possible to develop an empirical function that relates change in Offset to change in K. The controller will find K Calibrated as in the first method and then calculate Offset from Offset=Empirical Function (K Calibrated). The empirical function will likely vary for each burner and flame rod combination.

It is thus seen that we have provided a modulating gas burner system that is more accurate than prior systems with the use of less expensive modulating gas valves. This has been accomplished by a closed loop feedback system and by utilizing the existing flame rod to provide gas pressure signals in addition to flame-out condition signals and by providing for calibration of the flame rod as it may change with time. It will be obvious that the system described for a furnace control may also be used for other gas burner control systems such as water heaters and boilers. Also, the various components described in connection with the preferred embodiment may have alternate equivalent components. For example, various kinds of igniters and differential pressure detectors, air movers and the like may be used in the present invention without departing from the spirit and scope of the present invention. Accordingly, we do not wish to be limited to the specific disclosures used in describing the preferred embodiment.

The invention claimed is:

1. In a burner control system having a gas supply, a gas valve for receiving gas from the gas supply and for controlling a gas pressure provided by the gas valve, an air source to be mixed with the gas provided by the gas valve to produce a gas/air mixture, a burner for producing a flame from the gas/air mixture resulting in a burning or burned gas/air mixture, a flame rod for detecting the presence of the flame produced by the burner, a heat exchanger for receiving the burning or burned gas/air mixture, a combustion fan for driving air from the air source such that it is be mixed with the gas provided by the gas valve and for driving the burning or burned gas/air mixture through the heat exchanger, the improvement comprising:

a controller for receiving a signal from the flame rod and for producing a control signal to the gas valve in accordance with a predetermined relationship between the flame rod signal and the gas pressure provided by the gas valve so as to position the gas valve in accordance with a desired gas pressure, and wherein the controller provides for calibration of the flame rod from time to time by setting the gas valve at a maximum open position to produce a known regulated gas pressure, and then detecting a corresponding flame rod signal, the controller further determining a measure of the gas pressure produced by the gas valve at a less than maximum open position by correlating the flame rod signal that is measured at the less than maximum open position with a corresponding a gas pressure value.

2. Apparatus according to claim 1 further comprising:

a pressure switch for determining a pressure caused by the combustion fan; and a connection from the pressure switch to the controller to provide the controller with a signal indicative of the flow through the combustion fan so that the controller produces a control signal to the combustion fan in accordance with a desired fan speed.

3. Apparatus according to claim 1 wherein the predetermined relationship is a linear equation of the form:

$$\text{Desired Flame Current} = K^* \text{ Firing Rate} + \text{Offset}.$$

4. Apparatus according to claim 1 further including means for modulating the amount of air that is provided from the air source that is to be mixed with the gas provided by the gas valve to provide a desired gas/air ratio for the gas/air mixture.

5. Apparatus according to claim 4 wherein the amount of air is modulated by modulating the fan speed of the combustion fan.

6. Apparatus according to claim 5 wherein the RPM of the combustion fan is supervised with an RPM sensor, and a signal indicative thereof is presented to the controller and the controller produces an output to the combustion fan to control the speed thereof.

7. Apparatus according to claim 6 wherein the maximum setting for the amount of air is calibrated by increasing the RPM of the combustion fan until a predetermined set point for a pressure switch is reached which corresponds to the maximum setting for the amount of air.

8. Apparatus according to claim 7 wherein the amount of air from the predetermined set point is proportional to the RPM of the fan at a temperature.

9. A burner control system comprising:

a modulating gas valve to produce a controlled gas flow, and having a gas output pressure that is related to the valve opening position;

a burner receiving a gas/air mixture from the gas flow and a source of air to provide a gas/air mixture which is to be ignited to produce a flame;

a flame rod for detecting the presence of flame and to produce a signal that is related to the gas output pressure of the valve;

a heat exchanger receiving heat from the flame and directing burning or burned gas/air mixture downstream;

a pressure responsive means for producing a signal indicative of a downstream pressure of the burning or burned gas/air mixture; and a controller for receiving the signal from the flame rod and the signal from the pressure responsive means to produce a control signal to the modulating gas valve in accordance with a predetermined relationship between the flame rod signal and the signal from the pressure responsive means so as to position the modulating gas valve in accordance with a desired gas pressure and wherein the controller provides for calibration of the flame rod from time to time by setting the modulating gas valve at a maximum open position to produce a known regulated gas pressure, and then detecting a corresponding flame rod signal, the controller further determining a measure of the gas pressure produced by the modulating gas valve at a less than maximum open position by correlating a flame rod signal that is measured at the less than maximum open position with a corresponding a gas pressure value.

10. The burner control system of claim 9 further including a combustion fan for driving the gas/air mixture through the heat exchanger.

11. The burner control system of claim 10 wherein the pressure responsive means includes a differential pressure responsive means that has differential pick up points located proximate the combustion fan.

12. The burner control system of claim 10 wherein the controller produces a control signal to the combustion fan in accordance with a desired fan speed.

13. Apparatus according to claim 12 wherein the controller sets the fan speed of the combustion fan to achieve a desired gas/air mixture for a given valve opening position of the modulating gas valve.

14. Apparatus according to claim 13 wherein the fan speed of the combustion fan is supervised with an RPM sensor and a signal indicative thereof is presented to the controller and the controller produces an output to the combustion fan to control the speed thereof.

15. Apparatus according to claim 14 wherein the combustion fan draws air from the source of air to provide the gas/air mixture, and the amount of airflow drawn from the source of air is calibrated by increasing the RPM of the combustion fan until a predetermined set point for the pressure responsive means is reached which corresponds to a maximum fan speed and maximum airflow.

16. Apparatus according to claim 15 wherein the airflow is proportional to the RPM of the fan at a given temperature.

17. A burner control system comprising:

a gas supply;

a valve receiving gas from the gas supply and controlling gas flow resulting in a gas pressure;

an air source to be mixed with the gas to produce a gas/air mixture;

a burner for producing a flame from the gas/air mixture which produces a burning or burned gas/air mixture;

a flame rod for detecting the presence of the flame;

a heat exchanger for receiving the burning or burned gas/air mixture;

a combustion fan for driving the burning or burned gas/air mixture through the heat exchanger, the heat exchanger directing at least some of any resulting heat to a desired space;

a pressure switch for detecting a maximum pressure caused by the combustion fan; and a controller for receiving a signal from the flame rod and for producing a control signal to the valve in accordance with a predetermined relationship between the flame rod signal and the gas pressure so as to position the valve in accordance with a desired gas pressure;

and wherein the controller provides for calibration of the flame rod from time to time by correlating a known regulated gas pressure produced when the valve is at a maximum open position with a measured flame signal from the flame rod when the valve is at a maximum open position;

and wherein the controller determines the gas pressure produced by the valve at a less than maximum open position by correlating a measured flame signal from the flame rod when the valve is at the less than maximum open position with a gas pressure value.

18. The method of controlling the flow of gas from a valve in a combustion control system including the steps of:

A. identifying the gas pressure produced by the valve using a signal produced by a flame rod;

B. sensing a pressure of a gas/air mixture produced by a combustion fan using a pressure sensor;

C. comparing the gas pressure with the pressure of the gas/air mixture;

D. controlling the opening of the valve and/or the speed of the combustion fan to produce a desired gas/air mixture, and, E. calibrating the flame rod from time to time by correlating a known regulated gas pressure produced when the valve is at a maximum open position with a measured flame signal from the flame rod when the valve is at a maximum open position.

19. The method of claim 18 further including the step of:

A1. Igniting the gas/air mixture and directing the burning or burned gases past the flame rod to a heat exchanger.

20. The method of claim 19 including the step of:

A2. directing the burning or burned gasses downstream with the combustion fan.

21. The method of combustion control comprising the steps of:

A. directing gas from a gas source to a gas valve to produce a gas output having a gas pressure;

B. mixing the gas output with airs and directing the mixture of gas and air to a burner;

C. directing the gas/air mixture to a heat exchanger past a flame rod to produce a flame rod output signal when the gas/air mixture is burning;

D. directing the burning or burned gas/air mixture in the heat exchanger to a combustion air fan for exhaust;

E. sensing the burning or burned gas/air pressure and providing a sensor signal;

F. comparing the sensor signal with the flame rod output signal, and producing a control signal;

G. adjusting the opening of the valve and/or the speed of the combustion fan in accordance with the control signal; and H. calibrating the flame rod from time to time by determining the gas pressure at a maximum opening of the valve.

22. A method for controlling a modulating combustion system, wherein the modulating combustion system includes a modulating gas valve for delivering a gas flow to a burner and a combustion fan for driving an air flow to the burner, wherein the gas flow and the air flow are mixed and ultimately burned at the burner, the combustion system further having a flame sensor positioned in the flame of the burner, the modulating gas valve having one or more regulated positions where for at least selected regulated position, the resulting gas pressure has a known value within a first tolerance, and one or more modulated positions where for at least selected modulated positions, the resulting gas pressure has a value within a second tolerance, wherein the first tolerance is tighter than the second tolerance, the method comprising, establishing the first tolerance;

establishing the second tolerance;

setting the gas valve to one of the one or more regulated positions;

receiving a flame sensor signal from the flame sensor, and adjusting one or more flame sensor calibration parameters to correlate the received flame sensor signal to the known value of the gas pressure for the set regulated position;

setting the gas valve to one of the one or more modulated positions;

receiving a flame sensor signal from the flame sensor, and correlating the flame sensor signal to a value of the gas pressure for the set modulated position using the one or more flame sensor calibration parameters; and continuing to set the gas valve to another one of the modulated positions, receive a flame sensor signal from the flame sensor, and correlate the flame sensor signal to the value of the gas pressure for the set modulated position using the one or more flame sensor calibration parameters until a desired gas pressure value is achieved.

23. The method of claim 22 further comprising:

increasing the fan speed of the combustion fan until a predetermined pressure is reached, resulting in a calibrated fan speed;

adjusting one or more fan calibration parameters to correlate the calibration fan speed to a first air flow to the burner; and setting the fan speed of the combustion fan to achieve a desired air flow using the one or more fan calibration parameters.

24. The method of claim 23 wherein the fan speed set by the setting step of claim 23 is dependent on the desired gas pressure value.

25. The method of claim 24 wherein the desired gas pressure value is dependent on the heat demand on the modulating combustion system.

26. The method of claim 22 wherein the desired gas pressure value is dependent on the heat demand on the modulating combustion system.

27. The method of claim 22 wherein the modulating combustion system operates in cycles whereby during each cycle, the burner burns for a time to produce heat, and then does not burn for a time, wherein the method steps of claim 22 are repeated for each cycle of the modulating combustion system.

* * * * *